US005638585A

United States Patent [19]

Mizuno

[11] Patent Number: 5,638,585

[45] Date of Patent: Jun. 17, 1997

[54] SEPARABLE BOTTOM-END-STOP ASSEMBLY OF SYNTHETIC RESIN FOR SLIDE FASTENER

[75] Inventor: Hiroshi Mizuno, Toyama-ken, Japan

[73] Assignee: YKK Corporation, Tokyo, Japan

[21] Appl. No.: 534,820

[22] Filed: Sep. 27, 1995

[30] Foreign Application Priority Data

Sep. 30, 1994 [JP] Japan ..... 6-237352

[51] Int. Cl.[6] ..... A44B 19/00

[52] U.S. Cl. ..... 24/433; 24/434; 24/435

[58] Field of Search ..... 24/432, 433, 434, 24/435, 436, 381, 388, 389

[56] References Cited

U.S. PATENT DOCUMENTS

| | | | |
|---|---|---|---|
| 2,502,885 | 4/1950 | Poux | 24/433 |
| 4,112,553 | 9/1978 | Weitzner | 24/433 X |
| 4,221,026 | 9/1980 | Kanzaka | 24/433 |
| 4,536,923 | 8/1985 | Murakami | 24/433 |
| 4,571,784 | 2/1986 | Okazaki | 24/433 |
| 4,571,785 | 2/1986 | Akashi | 24/433 |
| 4,587,694 | 5/1986 | Asahi et al. | 24/435 |
| 4,742,063 | 5/1988 | Kasai | 24/433 |
| 5,007,145 | 4/1991 | Kim | 24/433 |
| 5,131,120 | 7/1992 | Akashi | 24/433 |
| 5,388,312 | 2/1995 | Fudaki | 24/433 X |
| 5,412,849 | 5/1995 | Fudaki | 24/433 X |
| 5,446,949 | 9/1995 | Fudaki | 24/433 |

FOREIGN PATENT DOCUMENTS

| | | |
|---|---|---|
| 0 116 880 | 8/1984 | European Pat. Off. . |
| 0 581 319 | 2/1994 | European Pat. Off. . |
| 0 595 248 | 5/1994 | European Pat. Off. . |
| 63-33530 | 9/1988 | Japan . |
| 6-46906 | 2/1994 | Japan . |
| 626 241 | 11/1981 | Switzerland . |
| 2 022 687 | 12/1979 | United Kingdom . |

*Primary Examiner*—Peter M. Cuomo
*Assistant Examiner*—Robert J. Sandy
*Attorney, Agent, or Firm*—Hill, Steadman & Simpson

[57] ABSTRACT

In a separable slide fastener, a separable bottom-end-stop assembly of synthetic resin is in the form of three-member structure composed of a first pin, a second pin and a box. The first pin has a locking portion. The box has first and second pin insertion bores separated by a central partition having a resilient locked portion engageable with the locking portion of the first pin. The box additionally has on the outer side of the first pin insertion bore a short side wall to be received in a cutout in a bottom end portion of one of opposite fastener stringers. Thus, the firm attachment of the box after sewing can be achieved.

17 Claims, 7 Drawing Sheets

SEPARABLE BOTTOM-END-STOP ASSEMBLY OF SYNTHETIC RESIN FOR SLIDE FASTENER

BACKGROUND OF THE INVENTION

1. Field of the Invention

This invention relates to a separable slide fastener, and more particularly to a separable bottom-end-stop assembly of synthetic resin which is in the form of a three-member structure composed of a box, a box pin and an insertion pin and in which the box can be threaded onto one of a pair of opposite fastener stringers after sewing.

2. Description of the Related Art

A separable bottom-end-stop assembly for a separable slide fastener is known which is in the form of a three-member structure composed of a box 1', a first pin 2' to be received in the box 1', and the second pin 3', in which the box 1' can be attached to the box pin 2' after sewing. The box 1' has front and back walls 7', 8' bridged by a central partition 6' to define first and second pin insertion bores 4', 5' one on each side of the partition 6'. The central partition 6' has a projection for pressing the inserted first pin 2' against one side wall. The front and back walls 7', 8' have projections to be received in the respective recesses in front and back surfaces of the first pin 2'. Thus the box 1' and the first pin 2' are fixedly attached to the bottom end portions of opposite fastener stringers S. (See Japanese Utility Model Publication No. Sho 63-33530 and FIG. 9 of the accompanying drawings.)

Also known is a three-member separable bottom-end-stop assembly, for a concealed separable slide fastener, which comprise a box 1" and first and second pins 2", 3", in which the box 1" can be attached to the first pin 2" after sewing. The box 1" has on its side wall an resilient locking tongue 9" designed to catch a hook 19" on the tip of the first pin, thus fixedly attaching the box 1" and the first pin 2" to one of opposite slide fasteners S. (See Japanese Patent Laid-Open Publication No. Hei 6-46906 and FIG. 10 of the accompanying drawings.)

The conventional separable bottom-end-stop assembly for a separable slide fastener is designed to have the first pin locked into the box, either by clenching the box over the first pin or by fusing the box and the first pin together, after the first pin is inserted into the box. Since the box is attached to one of opposite fastener stringers before sewing to a garment, the sewing work is obstructed. It is also very difficult to manufacture a small-sized separable bottom-end-stop assembly to fit a narrow slide fastener, which durability is too poor for its production.

In the first-named conventional separable bottom-end-stop assembly, the projection 9' on the central partition 6' of the box 1' merely projects toward the first pin insertion bore 4' and does not serve to lock the first pin 2'. Actually the first pin 2' is secured by the projections 10' on the inner walls of the box 1' which are received in the corresponding recesses on the front and back side surfaces of the first pin 2'. Therefore, in the event the fastener stringers S are moved laterally along the inner longitudinal margin, the first pin 2' is vulnerable to laterally sway inside the first pin insertion bore 4'. Also, the resilient projections 9' on the central partition 6' allow the first pin 2' to get loosen, thereby causing the box rattle to make the whole unit nonstable.

The second-named conventional separable bottom-end-stop assembly is designed for a concealed slide fastener and therefore is not universally applicable to ordinary slide fasteners. Moreover, the hook 20" on one side of the first pin 2" is engageable with the locking strip on the central partition 6" of the box 1". Further, the first pin 2" has another hook 19" engageable with the corresponding locking tongue 9" on the side wall of the box 1" so that the box 1" and the first pin 2" are secured to each other under normal conditions. When opposing force is applied between the box 1" and the fastener stringers S, however, the locking tongue 9" comes off the hook, so that the hook 20" comes into engagement with the locking strip on the central partition 6". Thus, the first pin 2", though not coming off the box 1", is held sufficiently stable in the box 1.

SUMMARY OF THE INVENTION

With the foregoing problems in view, it is an object of this invention to provide a separable bottom-end-stop assembly, especially a small-sized one for a narrow slide fastener chain, which can be assembled in a simple process. Namely, opposed fastener stringers are sewn to a garment with a box removed off one fastener stringer, and then the box can be attached to the one fastener stringer firmly and neatly without difficulty, thus achieving a high durability against any way of use.

In order to accomplish the above object, according to this invention, there is provided a separable bottom-end-stop assembly of synthetic resin for a separable slide fastener including a pair of fastener stringers, each including a stringer tape carrying on its inner longitudinal margin a row of coupling elements, the assembly comprising: a first pin adapted to be attached to the bottom end portion of the inner tape margin of one fastener stringer, the first pin having a locking portion; a second pin adapted to be attached to the bottom end portion of the inner tape margin of the other stringer; and a box having first and back walls, including first and second pin insertion bores separated by a central longitudinal partition having a resilient locked portion engageable with the locking portion of the first pin, the box having on the outer side of the first pin insertion bore a short side wall; the one fastener stringer having in the bottom end portion of the inner tape margin adjacent to an outer surface of an end portion of the first pin a cutout adapted to receive the short side wall.

Further, the locked portion is separated from the front and back walls of the box and has on one surface toward the first pin insertion bore a serrated portion, and the locking portion has a serrated inner surface to be engaged with the serrated portion of the locked portion.

Preferably, the locked portion is in the form of a resilient plate bulging toward the first pin insertion bore, and the locking portion is in the form of a hook projecting inwardly from the end portion of the first pin to be engaged with the resilient plate.

Furthermore, the box has between the locked portion and the second pin insertion bore and between the front and back walls a stop to contact with the locked portion so as to prevent the locked portion from resiliently bending toward the second pin insertion bore.

Still further, the assembly includes a first pin support and a second pin support, the first pin support having a first grip portion so as to define between the first grip portion and the first pin a first guide groove, the second pin support having a second grip portion so as to define between the second grip portion and the second pin a second guide groove. The first pin and the first pin support are integrally formed on the bottom end portion of the one fastener stringer by injection molding using synthetic resin, while the second pin and the second pin support are integrally formed on the bottom end portion of the other fastener stringer by injection molding using synthetic resin.

Preferably, the bottom end portion of each stringer on which the first and second pin supports as well as the first and second pins are to be formed may be either with or without coupling elements. Further, it may have a cut-out portion to be covered by the pins and supports which are formed thereon by injection-molding.

Furthermore, the cutout has a length equal to the length of the short side wall and is formed in a bottom of the first guide groove of the first pin support, while the second pin support having a second cutout in a bottom of the second guide groove of the second pin support, the second cutout having a length equal to the length of another short side wall opposite to the first-named side wall. The box has a flat outer bottom surface and the bottom end portion of each of the fastener stringers has a straight transverse cut end substantially in alignment with the flat outer bottom surface of the box.

In operation, the separable bottom-end-stop assembly of thermoplastic synthetic resin according to this invention, thanks to the structure described above, enables the fastener stringers, with the first and second pins attached beforehand, to be sewn onto a garment first, then the slider to be inserted from the first pin so that the first pin is plugged into the first pin insertion bore of the box to lock the locked portion and the locking portion, thus achieving the stable attachment of the box and the first pin. The assembly as a whole may be attached to the fastener chain from the beginning when necessary.

The slider may be threaded onto the fastener stringer to which the box is attached before sewing the fastener stringers onto the garment. If the slider is in the way of sewing process, the slider can be moved up or down to make the sewing easy. With the fastener stringers once attached to the garment, the slide fastener can be opened and closed by the ordinary separation process.

DETAILED DESCRIPTION OF PREFERRED EMBODIMENTS

The principle of this invention is particularly useful when embodied in a separable bottom-end-stop assembly of synthetic resin such as shown in the accompanying drawings. Various preferred embodiments of this invention will now be described in detail with reference to the accompanying drawings.

Figure 1:
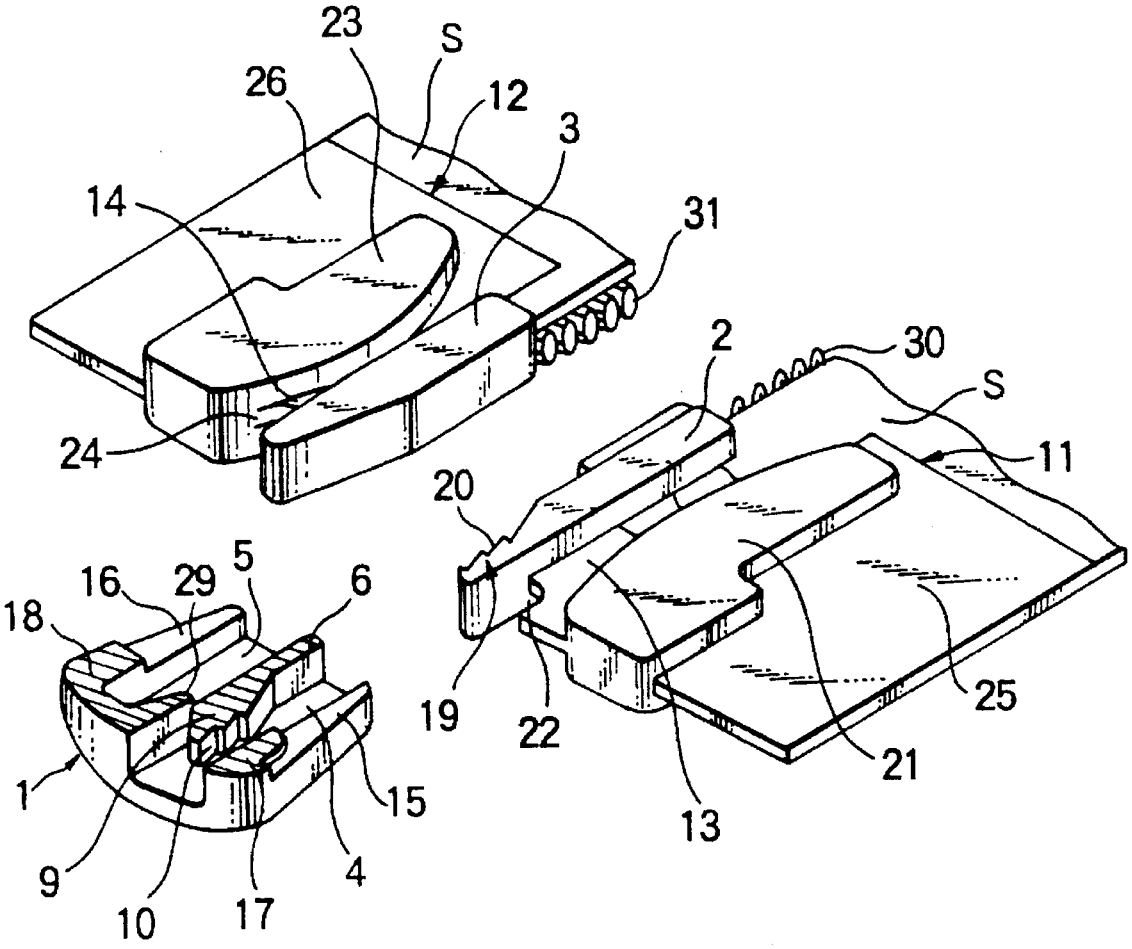
FIG. 1 is an exploded perspective view, partly in cross section, of a separable bottom-end-stop assembly according to a first embodiment of this invention.
Figure 2:
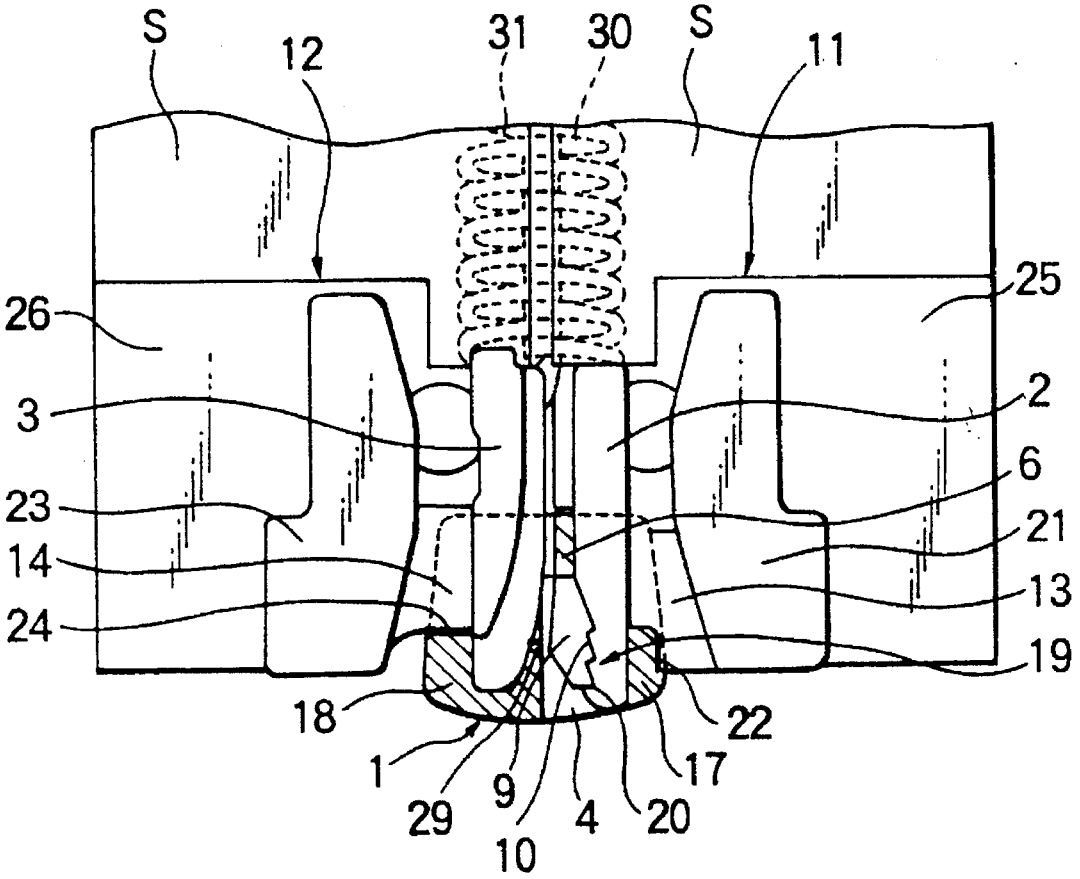
FIG. 2 is a front view, partly in cross section, of the separable bottom-end-stop assembly of FIG. 1 as assembled.
Figure 3:
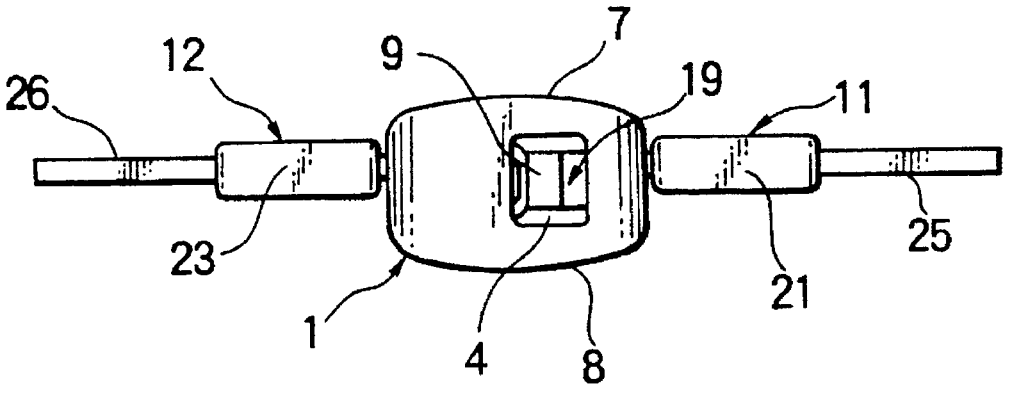
FIG. 3 is a bottom view of of the separable bottom-end-stop assembly of FIG. 2.

The separable bottom-end-stop assembly of this invention, as shown in FIGS. 1, 2 and 3, is in the form of a three-member structure composed of a box 1, a first pin 2 and a second pin 3. The box 1 has a first pin insertion bore 4 into which the first pin 2 is to be inserted, and a second pin insertion bore 5 into which the second pin is to be inserted. The first pin insertion bore 4 should preferably be bottomless, while the second pin insertion bore 5 may be with or without a bottom.

The first and second insertion bores 4, 5 are separated by a central partition 6, the bottom end of which is formed a locked portion 9 separate from front and back walls 7, 8 of the box 1. The locked portion 9 is laterally resiliently deformable and extends vertically downwardly from its bottom edge. The locked portion 9 further has a serrated surface 10 facing the first pin insertion bore 4. Further, the bottom-end-bottom assembly includes on both sides of the box 1 first and second pin supports 11, 12 attached to bottom end portions of opposite fastener stringers S and associated with the first and second pins 2, 3. The first pin support 11 has a first grip portion 21 of a certain thickness connected with the first pin 2 by a bridge so as to define between the first grip portion 21 and the first pin 2 a first guide groove 13 so as that a slider flange can go through. Likewise the second pin support 12 has a second grip portion 23 connected with the second pin 2 by a bridge portion so as to define between the second grip portion 23 and the second pin 3 a second guide groove 14 so as that the other slider flange can go through. The box 1 has in each of opposite side walls side grooves 15, 16 so as to receive the respective bridge of the first/second pin support 11, 12, thus forming first/second short side walls 17, 18 at the end portions of the side grooves 15, 16. The box 1 further has between the locked portion 9 and the second pin insertion bore 5 a stop 29 projecting upwardly from the bottom of the box 1 and to contact with the locked portion 9 so as to prevent the locked portion 9 from resiliently bending toward the second pin insertion bore 5, for a purpose described later.

The first pin 2 has a generally square cross-section shape and adapted to be attached to the bottom end portion of the inner tape margin of one fastener stringer S, continuously to fastener elements 30. The first pin 2 has a locking portion 19 adapted to have a serrated inner surface 20 engageable with the serrated surface 10 of the locked portion 9 of the box 1. Alternatively, these serrated surfaces 10, 20 may have any other shapes so as to be engaged with each other, such as mere hooks.

The first pin support 11 has, in the bridge at a position adjacent to the outer surface of the bottom end portion of the first pin 2, a first cutout 22 adapted to receive the first short side wall 17. Likewise the second pin support 12 has, in the bridge at a position adjacent to the outer surface of the bottom end portion of the second pin 3, a second cutout 24 adapted to loosely receive the second short side wall 18.

The first pin 2 and the first pin support 11 are integrally formed on the bottom end portion of one fastener stringer S by injection molding using synthetic resin.

Likewise the second pin 3 and the second pin support 12 are integrally formed on the bottom end portion of the other fastener stringer S by injection molding using synthetic resin. The bottom end portions of the fastener stringers S may be void of coupling elements 30, 31, which may be left over as they are. Or the fastener stringers S may have cut-out portions at their respective bottom end portions so as that the first and second pins 2, 3 and the first and second pin supports 11, 12 are formed integrally on the bottom end portions by injection molding so as to cover the cut-out portions. The second pin 3 has a generally square cross-sectional shape and adapted to be attached to the bottom end portion of the fastener stringer S, continuously to the coupling elements 31, and the end portion of the second pin 3 has an arcuate inner surface adapted to be generally aligned with the bottom of the second pin insertion bore 5, as shown in FIG. 2.

The bottom end portion of each fastener string S is covered on each side surface by a synthetic resin film, adhered or fused, or is alternatively reinforced with synthetic resin material, initially in liquid form to permeate into the knit or weave structure of the fastener tape and finally coagulated there, to form first and second reinforced portions 25, 26. A set of the first pin 2 and the first pin support 11, or a set of the second pin 3 and the second pin support 12, is integrally molded on the reinforced portion 25, 26. Alternatively the first and second pins 2, 3 and the first and second pin supports 11, 12 as well as the reinforced portions 25, 26 may be simultaneously molded. The synthetic resin is preferably polyamide, polypropylene or polyacetal. The box 1 may be attached to the fastener stringer S either manually or by automation.

The illustrated fastener chain is a concealed type comprising a pair of fastener stringers S each including a fastener tape carrying on and along its inner longitudinal margin a row of the coiled coupling elements 30, 31 sewn to the rear surface of the fastener tape. Alternatively, coiled coupling elements may be sewn to the front surface of the stringer tape. This invention should by no means be limited to the illustrated examples, so may be applied to other types of fastener chain in which, for example, discrete coupling elements may be injection molded of synthetic resin, or metallic coupling elements may be mounted.

Figure 4:
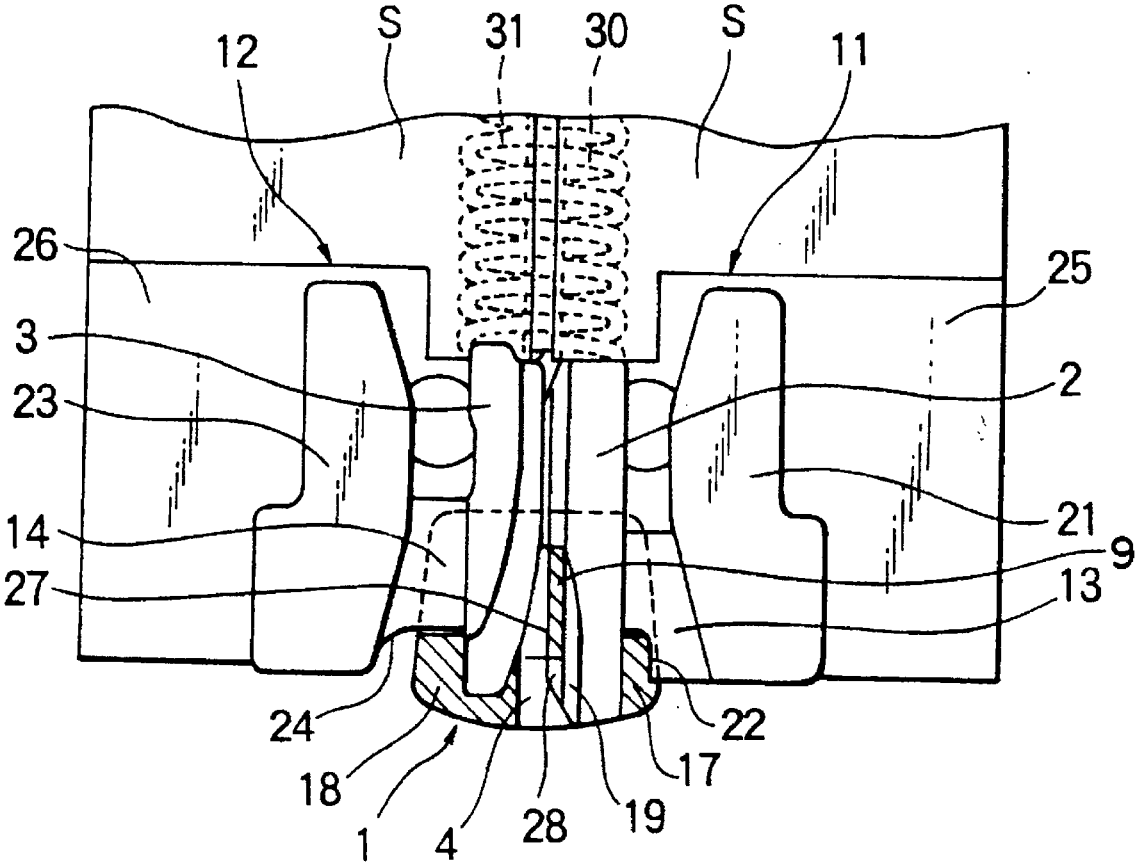
FIG. 4 is a front view, partly cross section, of the separable bottom-end-stop assembly, according to a second embodiment.
Figure 5:
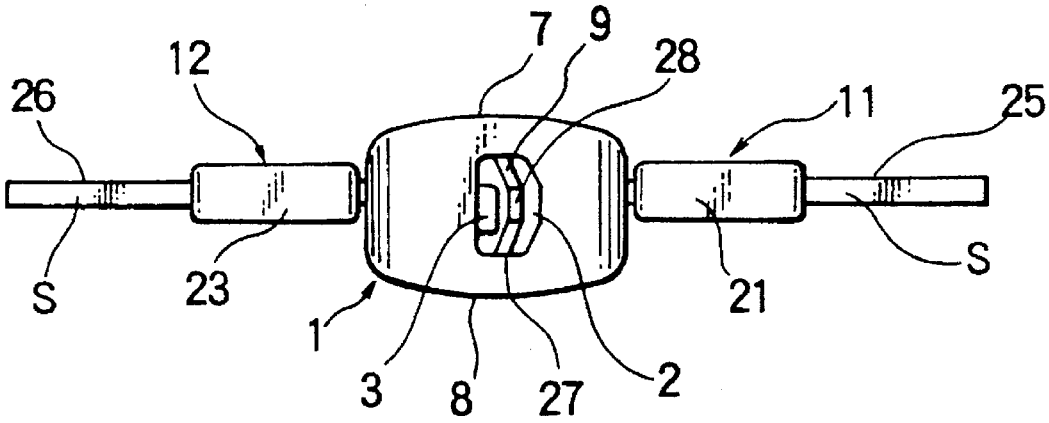
FIG. 5 is a bottom view of the separable bottom-end-stop assembly of FIG. 4.

FIGS. 4 and 5 show a modified separable bottom-end-stop assembly which is identical in construction with the foregoing embodiment except that the central partition 6 between the first and second pin insertion bores 4, 5 of the box 1 is in the form of a resilient plate 27 bulging toward the first pin insertion bore 4. The resilient plate 27 serves as the locked portion 9 of the previous embodiment. On the other hand, the first pin 2 has a hook 28 projecting inwardly from its bottom end and serving as the locking portion 19 of the previous embodiment. The hook 28 is caught by the bottom edge of the resilient plate 27.

Figure 6:
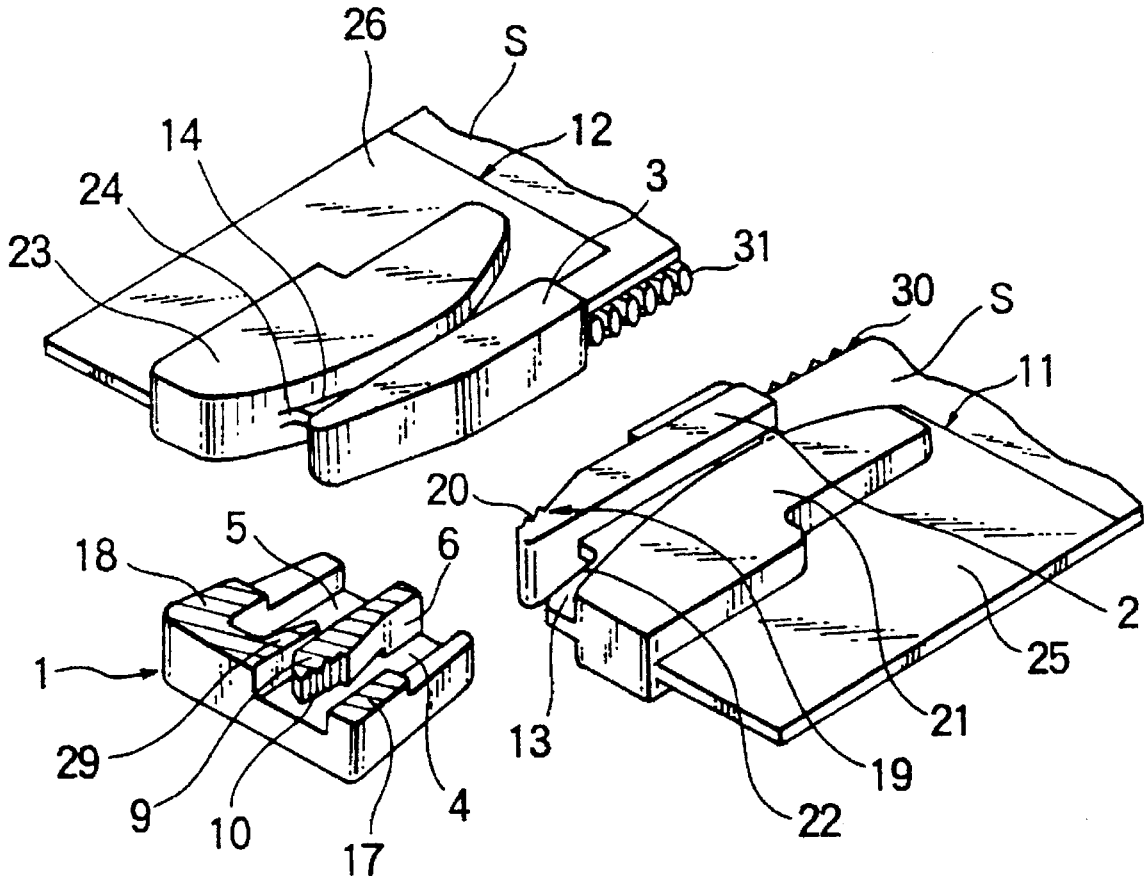
FIG. 6 is an exploded perspective view, partly in cross section, of the separable bottom-end-stop assembly according to a third embodiment.
Figure 7:
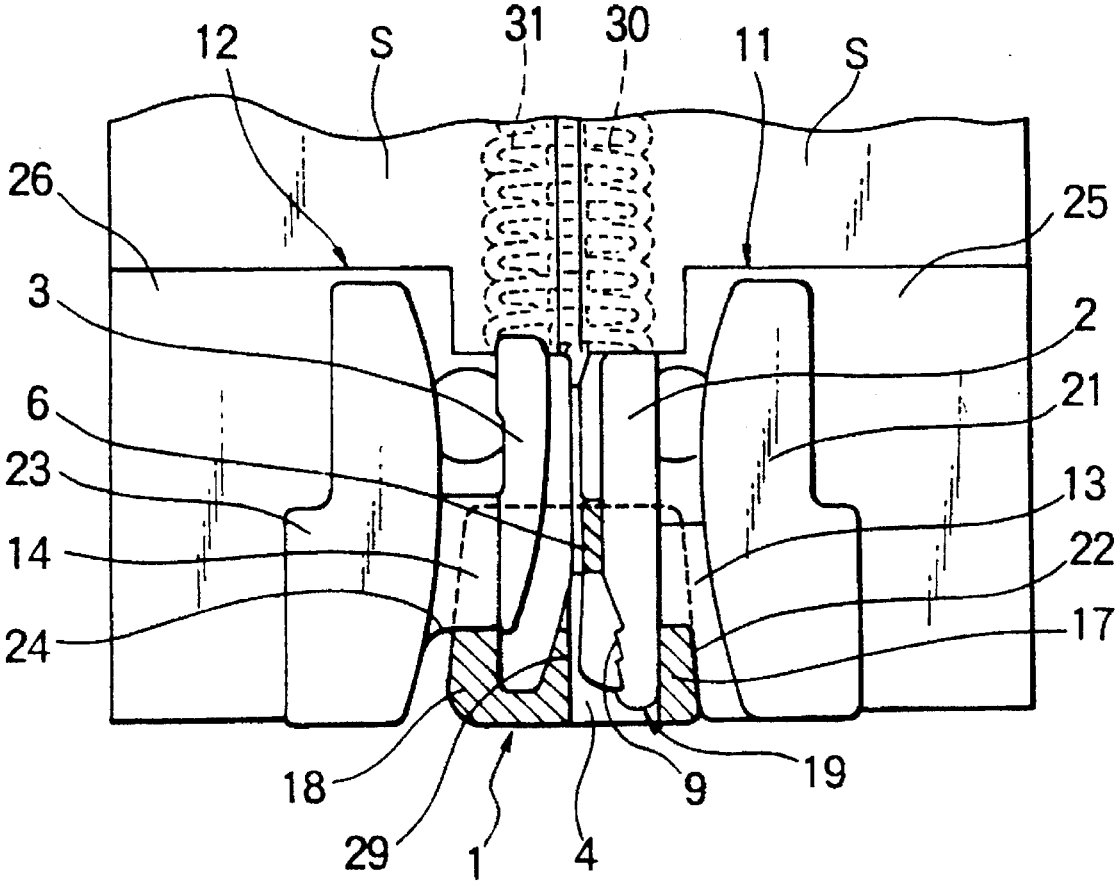
FIG. 7 is a front view, partly in cross section, of the separable bottom-end-stop assembly of FIG. 6 as assembled.
Figure 8:
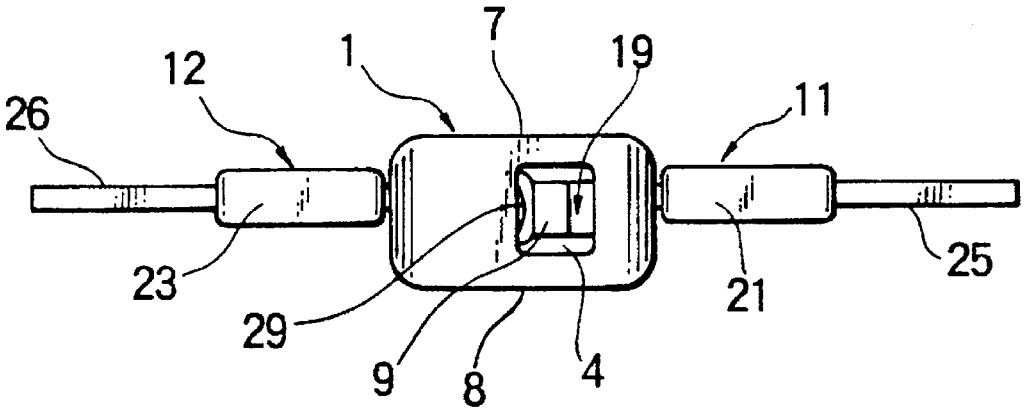
FIG. 8 is a bottom view of of the separable bottom-end-stop assembly of FIG. 7.
Figure 9:
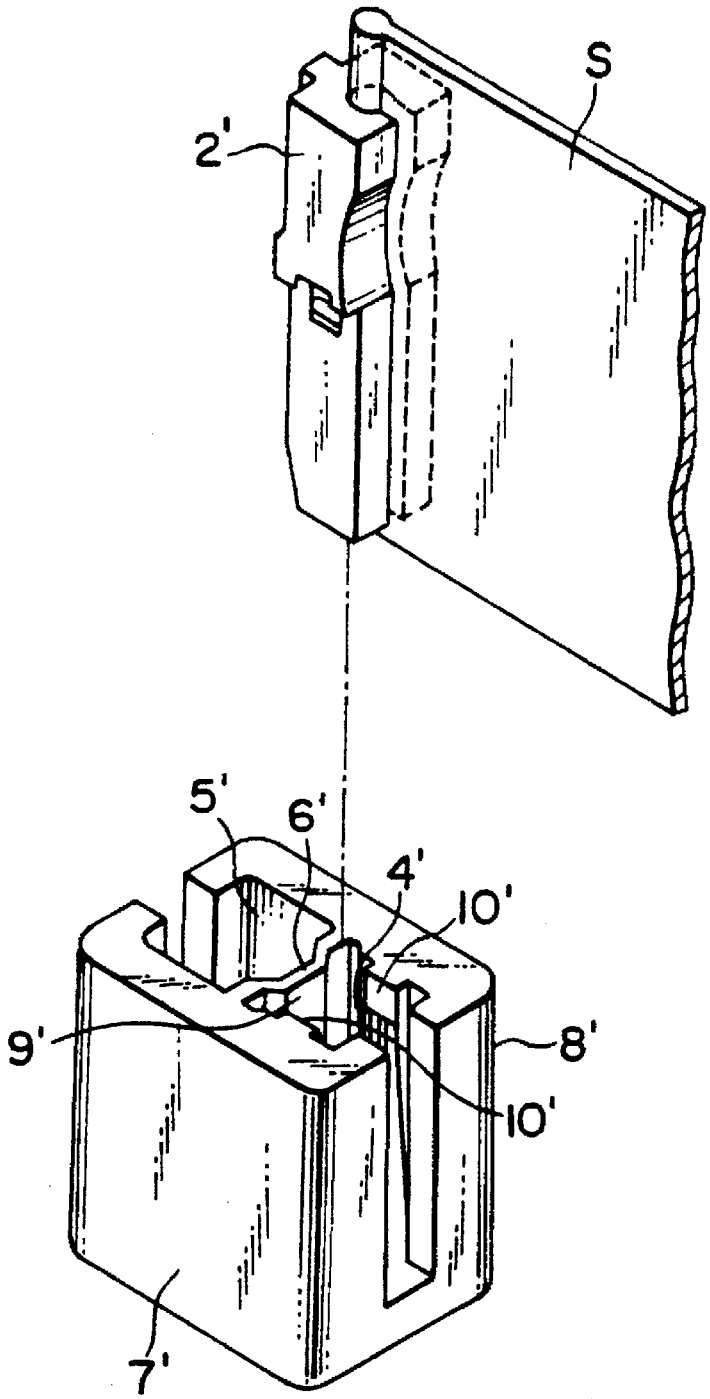
FIG. 9 PRIOR ART
FIG. 9 is a fragmentary exploded perspective view of a conventional separable bottom-end-stop assembly, showing a box and a first pin.
Figure 10:
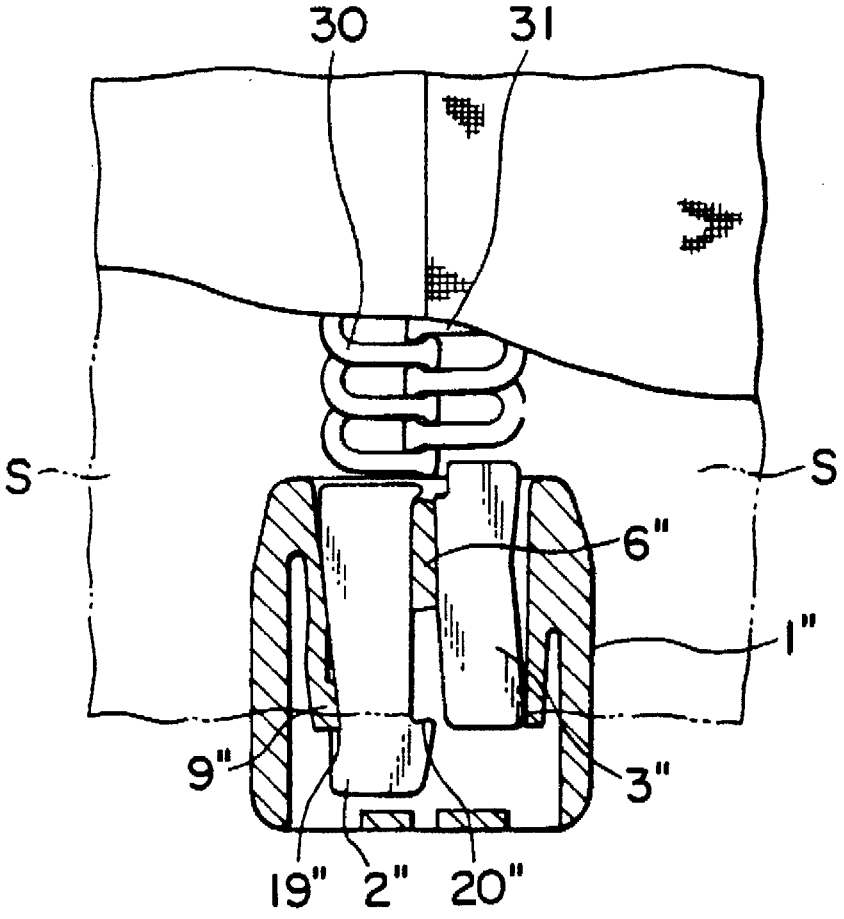
FIG. 10 PRIOR ART
FIG. 10 is a front view, partly in cross section, of a conventional separable bottom-end-stop assembly for a concealed slide fastener.

FIGS. 6, 7 and 8 show another modified separable bottom-end-stop assembly in which the projection on the side surface of the second pin insertion pin 5 of the box 1 extends to form a vertical stop 29 between the front and back walls 7, 8 to contact with engage the locked portion 9 so that the locked portion 9 is prevented from escaping or retracting toward the second pin insertion bore 5. The gap between the stop 29 and the locked portion 9 is slightly smaller than the depth of the serrated surface 10 in the locked portion 9 and preferably in such a size that the first pin 2 can be inserted in snap action.

The first cutout 22 located in the bottom edge of the bridge of the first pin support 11 has a length equal to the length of the first short side wall 17 of the box 1 so that the first short side wall 17 can be fully received in the first cutout 22. The first pin support 11 is injection molded in such a manner that its bottom edge is aligned with the bottom edge of the fastener stringer S. Also, the box 1 is molded so as to have a outer bottom surface assuming a straight transverse line aligned with the bottom ends of the fastener stringers S as viewed in the bottom view. Thus, when attaching the box 1 to the fastener stringer S, the box 1, the first pin support 11 and the fastener stringer S are substantially aligned with one another's bottom edge.

Likewise, the second cutout 24 located in the bottom edge of the bridge of the second pin support 12 has a length substantially equal to the length of the second short side wall 18 of the box 1 so that the short side wall 18 is fully covered up. The second pin support 12 is injection molded on the bottom end portion of the other fastener stringer S in such a manner that the flat outer bottom surface of the second pin support 12 is substantially aligned with the straight bottom edge of the fastener chain, thus guaranteeing a slide fastener neat in appearance.

The separate bottom-end-stop assembly of synthetic resin according to this invention has the following advantageous results:

The separable bottom-end-stop assembly, comprises the center partition 6 of the box 1 having a resilient locked portion 9, the first pin 2 as a locking portion 19 eagageable with the locked portion 2, and the first pin support 11 having in the bridge at a position adjacent to the bottom end portion of the first pin 2 a first cutout 22 adapted to receive the first short side wall 17. According to this arrangement, in spite of the separate bottom-end-stop assembly of the type in which the box 1 is to be attached after the sewing process, it is possible to secure the first pin 2 and the box 1 firmly with maximum ease. In addition, since the first short side wall 17 of the box 1 is received in the first cutout 22, the box 1 can be secured to the fastener stringer S firmly. It is also possible to apply the assembly to a small-sized separable bottom-end-stop assembly for narrow fastener chains, though it has been difficult with the coventional one. Also it is possible to assemble either by manually or by automation.

Further, partly since the locked portion 9 is separated from the front and back walls 7, 8 of the box 1 and has a serrated inner surface 10, and partly since the locking portion of the box pin 2 also has serration, it is possible to form resilient locked and locking portions with maximum ease, and it is possible to secure the box 1 to the first pin 2 firmly for the serration-to-serration engagement.

In an alternative form, partly since the locked portion is in the form of a resilient plate 27 bulging toward the first pin insertion bore, and partly since the first pin has a hook on the tip, the first and second pins 2, 3 with locked and locking portions 9, 19 can be formed with maximum ease, and the interengagement between the locked and locking portions 9, 19 is easy to achieve.

Since the box 1 has between the front and back walls 7, 8 a stop 29 to contact with the locked portion 9 to prevent the latter from escaping or retracting toward the second pin insertion bore 5, it is possible to maintain firm engagement between the locked and locking portions 9, 19 so that adequate durability can be obtained even though it is a small-sized separable bottom-end-stop assembly.

Further, since a set of the first pin 2 and the first pin support 11, or a set of the second pin 3 and the second pin support 12, is integrally formed on the coupling-element-free bottom edge or the cut-out portion of the fastener stringer, it is possible to attach the first and second pin supports 11, 12 to the respective fastener stringers S firmly and it is also possible to secure the first and second pins 2, 3 stably, causing an adequate degree of durability.

Furthermore, partly since each of the first and second cutouts 22, 24 has a length equal to the length of the respective short side walls 7, 8, and partly since the box 1 has a flat outer bottom surface substantially in alignment with the straight bottom edge of the fastener, it is possible to finish the bottom end of the fastener chain neatly in appearance.

What is claimed is:

1. A separable bottom-end-stop assembly of synthetic resin for a separable slide fastener and including a pair of fastener stringers, each including a stringer tape carrying on its inner longitudinal margin a row of coupling elements, said assembly comprising:

a first fastener stringer and a second fastener stringer;

a first pin adapted to be attached to a bottom end portion of an inner tape margin of said first fastener stringer, said first pin having a locking portion;

a second pin adapted to be attached to a bottom end portion of an inner tape margin of the second stringer; and a box having front and back walls, including first and second pin insertion bores separated by a central partition having a resilient locked portion engageable with said locking portion of said first pin, said box having on the outer side of said first pin insertion bore a short side wall;

said first fastener stringer having in the bottom end portion of the inner tape margin adjacent to an outer surface of an end portion of said first pin a cutout adapted to receive said short side wall.

2. A separable bottom-end-stop assembly of synthetic resin for a separable slide fastener including a pair of fastener stringers, each including a stringer tape carrying on its inner longitudinal margin a row of coupling elements, said assembly comprising:

a first pin adapted to be attached to a bottom end portion of an inner tape margin of a first fastener stringer, said first pin having a locking portion;

a second pin adapted to be attached to a bottom end portion of an inner tape margin of a second fastener stringer; and a box having front and back walls, including first and second pin insertion bores separated by a central partition having a resilient locked portion engageable with said locking portion of said first pin, wherein said locked portion is separated from said front and back walls of said box and has on one surface toward said first pin insertion bore a serrated portion, and said locking portion has a serrated inner surface.

3. A separable bottom-end-stop assembly of synthetic resin for a separable slide fastener including a pair of fastener stringers, each including a stringer tape carrying on its inner longitudinal margin a row of coupling elements, said assembly comprising:

a first pin adapted to be attached to a bottom end portion of an inner tape margin of a first fastener stringer, said first pin having a locking portion;

a second pin adapted to be attached to a bottom end portion of an inner tape margin of a second fastener stringer; and a box having front and back walls, including first and second pin insertion bores separated by a central partition having a resilient locked portion engageable with said locking portion of said first pin; wherein said locked portion is in the form of a resilient plate bulging toward said first pin insertion bore, and said locking portion is in the form of a hook projecting inwardly from the end portion of said first pin.

4. A separable bottom-end-stop assembly of synthetic resin for a separable slide fastener including a pair of fastener stringers, each including a stringer tape carrying on its inner longitudinal margin a row of coupling elements, said assembly comprising:

a first pin adapted to be attached to a bottom end portion of an inner tape margin of a first fastener stringer, said first pin having a locking portion;

a second pin adapted to be attached to a bottom end portion of an inner tape margin of a second stringer; and a box having front and back walls, including first and second pin insertion bores separated by a central partition having a resilient locked portion engageable with said locking portion of said first pin; wherein said box has between said locked portion and said second pin insertion bore and between said front and back walls a stop to contact with said locked portion so as to prevent said locked portion from resiliently bending toward said second pin insertion bore.

5. A separable bottom-end-stop assembly of synthetic resin for a separable slide fastener and including a pair of fastener stringers, each including a stringer tape carrying on its inner longitudinal margin a row of coupling elements, said assembly comprising:

a first fastener stringer and a second fastener stringer;

a first pin adapted to be attached to a bottom end portion of an inner tape margin of the first fastener stringer, said first pin having a locking portion;

a second pin adapted to be attached to a bottom end portion of an inner tape margin of the second fastener stringer; and a box having front and back walls, including first and second pin insertion bores separated by a central partition having a resilient locked portion engageable with said locking portion of said first pin; wherein said assembly further includes a first pin support and a second pin support, said first pin support having a first grip portion so as to define between said first grip portion and said first pin a first guide groove, said second pin support having a second grip portion so as to define between said second grip portion and said second pin a second guide groove, and wherein said first pin and said first pin support are integrally formed on a bottom end portion of said first fastener stringer by injection molding, while said second pin and said second pin support are integrally formed on the bottom end portion of said second fastener stringer by injection molding.

6. A separable bottom-end-stop assembly according to claim 1, wherein said assembly further includes a first pin support and a second pin support, said first pin support having a first grip portion so as to define between said first grip portion and said first pin a first guide groove, said second pin support having a second grip portion so as to define between said second grip portion and said second pin a second guide groove, and wherein said first pin and said first pin support are integrally formed on the bottom end portion of said first fastener stringer by injection molding, while said second pin and said second pin support are integrally formed on the bottom end portion of said second fastener stringer by injection molding.

7. A separable bottom-end-stop assembly according to claim 1, wherein said locked portion is separated from said front and back walls of said box and has on one surface toward said first pin insertion bore a serrated portion, and said locking portion has a serrated inner surface.

8. A separable bottom-end-stop assembly according to claim 1, wherein said locked portion is in the form of a resilient plate bulging toward said first pin insertion bore, and said locking portion is in the form of a hook projecting inwardly from the end portion of said first pin.

9. A separable bottom-end-stop assembly according to claim 1, wherein said box has between said locked portion and said second pin insertion bore and between said front and back walls a stop to contact with said locked portion so as to prevent said locked portion from resiliently bending toward said second pin insertion bore.

10. A separable bottom-end-stop assembly according to claim 6, wherein said cutout has a length equal to the length of said short side wall and is formed in a bottom of said first guide groove of said first pin support, while said second pin support having a second cutout in a bottom of said second guide groove of said second pin support, said second cutout having a length equal to the length of another short side wall opposite to the first-named side wall, and wherein said box has a flat outer bottom surface and the bottom end portion of each of said fastener stringers has a straight transverse cut end substantially in alignment with said flat outer bottom surface of said box.

11. A separable bottom-end-stop assembly according to claim 9, wherein said locked portion is separated from said front and back walls of said box and has on one surface toward said first pin insertion bore a serrated portion, and said locking portion has a serrated inner surface.

12. A separable bottom-end-stop assembly according to claim 9, wherein said locked portion is in the form of a resilient plate bulging toward said first pin insertion bore, and said locking portion is in the form of a hook projecting inwardly from the end portion of said first pin.

13. A separable bottom-end-stop assembly according to claim 10, wherein said box has between said locked portion and said second pin insertion bore and between said front and back walls a stop to contact with said locked portion so as to prevent said locked portion from resiliently bending toward said second pin insertion bore.

14. A separable bottom-end-stop assembly according to claim 7, wherein said assembly further includes a first pin support and a second pin support, said first pin support having a first grip portion so as to define between said first grip portion and said first pin a first guide groove, said second pin support having a second grip portion so as to define between said second grip portion and said second pin a second guide groove, and wherein said first pin and said first pin support are integrally formed on the bottom end portion of said one fastener stringer by injection molding, while said second pin and said second pin support are integrally formed on the bottom end portion of said other fastener stringer by injection molding.

15. A separable bottom-end-stop assembly according to claim 14, wherein said cutout has a length equal to the length of said short said side wall and is formed in a bottom of said first guide groove of said first pin support, while said second pin support having a second cutout in a bottom of said second guide groove of said second pin support, said second cutout having a length equal to the length of another short side wall opposite to the first-named side wall, and wherein said box has a flat outer bottom surface and the bottom end portion of each of said fastener stringers has a straight transverse cut end substantially in alignment with said flat outer bottom surface of said box.

16. A separable bottom-end-stop assembly according to claim 8, wherein said assembly further includes a first pin support and a second pin support, said first pin support having a first grip portion so as to define between said first grip portion and said first pin a first guide groove, said second pin support having a second grip portion so as to define between said second grip portion and said second pin a second guide groove, and wherein said first pin and said first pin support are integrally formed on the bottom end portion of said one fastener stringer by injection molding, while said second pin and said second pin support are integrally formed on the bottom end portion of said other fastener stringer by injection molding.

17. A separable bottom-end-stop assembly according to claim 16, wherein said cutout has a length equal to the length of said short said side wall and is formed in a bottom of said first guide groove of said first pin support, while said second pin support having a second cutout in a bottom of said second guide groove of said second pin support, said second cutout having a length equal to the length of another short side wall opposite to the first-named side wall, and wherein said box has a flat outer bottom surface and the bottom end portion of each of said fastener stringers has a straight transverse cut end substantially in alignment with said flat outer bottom surface of said box.

* * * * *